US006479930B1

(12) United States Patent
Tanabe et al.

(10) Patent No.: US 6,479,930 B1
(45) Date of Patent: Nov. 12, 2002

(54) DISPERSION-TYPE ELECTROLUMINESCENCE ELEMENT

(75) Inventors: Koji Tanabe, Katano (JP); Heiji Ikoma, Ikoma-gun (JP); Naohiro Nishioka, Hirakata (JP); Yosuke Chikahisa, Katano (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/349,406

(22) Filed: Jul. 8, 1999

(30) Foreign Application Priority Data

Jul. 14, 1998 (JP) ..... 10-198510
Sep. 3, 1998 (JP) ..... 10-249362

(51) Int. Cl.[7] ..... H05B 33/00
(52) U.S. Cl. ..... 313/509; 313/506
(58) Field of Search ..... 313/509, 506, 313/503, 504, 512, 498

(56) References Cited

U.S. PATENT DOCUMENTS 3,786,307 A * 1/1974 Robinson ..... 313/506
5,874,803 A * 2/1999 Garbuzov et al. ..... 313/506

FOREIGN PATENT DOCUMENTS

| | | |
|---|---|---|
| JP | 60-130097 | 7/1985 |
| JP | 05135875 | 1/1991 |
| JP | 06231882 | 8/1994 |
| JP | 07176383 | 7/1995 |
| JP | 11111456 | 9/1997 |
| JP | 10189244 | 7/1998 |

* cited by examiner

*Primary Examiner*—Vip Patel
*Assistant Examiner*—Joseph Williams
(74) *Attorney, Agent, or Firm*—Parkhurst & Wendel, L.L.P.

(57) ABSTRACT

A dispersion-type electroluminescence element composed of a plurality of light-transmitting electrode layers 12A, 12B and a plurality of luminescence layers 13A, 13B of dielectric resin having a high permittivity dispersed with fluorescent powder stacked one layer after the other over the whole region, or in a certain specific region, of one surface of a light-transmitting insulation film 1; and a back electrode layer 14 provided on the last layer of the luminescence layers formed by a printing process. The electroluminescence element is capable of producing a multiple number of luminescence colors, yet the cost is low. In other example of carrying out the present invention, a luminescence layer 23 formed of a luminous body of one single luminescence color provided over a whole region of a surface is sandwiched by a back electrode layer 25 and a light-transmitting electrode layer 22 composed of two groups of fine line comb-teeth layer coupled one tooth after the one of the other electrode layer, and a stripe-shaped color conversion layer 27 is provided in a location corresponding to one of the two groups of comb-teeth fine lines. When an AC voltage is applied on the back electrode layer 25 and each of the two respective light-transmitting electrode layers 22 independently, a multiple number of luminescence colors are produced in a homogeneous plane luminescence, without accompanying the stripes outstanding to the eyes.

22 Claims, 8 Drawing Sheets

DISPERSION-TYPE ELECTROLUMINESCENCE ELEMENT

FIELD OF THE INVENTION

The present invention relates to a dispersion-type electroluminescence element (dispersion-type EL element) for use in various electronic appliances as back lighting for the display section or the operating section.

BACKGROUND OF THE INVENTION

An increasing number of electronic appliances, which have been diversifying into quite a number of different configurations, incorporate a back lighting tool behind their liquid crystal display panels or operating sections in order to facilitate an easier handling or an easier recognition by the eyes in the darkness. Dispersion-type EL elements have been widely used as the back lighting tool.

A conventional dispersion-type EL element is described in the following with reference to the drawings.

In the drawings, the illustrations have been shown magnified in the direction of thickness for the sake of easier description of the structure.

FIG. 16 is a cross sectional view of a conventional dispersion-type EL element. On one of the surfaces of a flexible light-transmitting insulation film 1 made of polyethylene terephthalate or the like material, a light-transmitting electrode layer 2 of indium tin oxide (hereinafter referred to as ITO) is formed through a sputtering process or an electron beam method. On top of the electrode layer 2, a luminescence layer 3 comprising a fluorocarbon rubber, cyano- group resin, or the like dielectric resin having a high permittivity dispersed with zinc sulfide or the like fluorescent powder as the luminous body, a dielectric layer 4 of dielectric resin having a high permittivity dispersed with barium titanate or the like dielectric powder, a back electrode layer 5 composed of silver, carbon-resin group or the like conductive material connected with the dielectric layer 4, and an insulation layer 6 composed of epoxy resin, polyester resin or the like material are formed one layer after the other in the order by a printing process.

Wiring patterns 7A, 7B composed of silver or a conductive material of carbon-resin group are connected at the end portion to the light-transmitting electrode layer 2 and the back electrode layer 5, respectively.

When a dispersion-type EL element of the above-described structure is incorporated in an electronic appliance and an AC voltage is provided from a circuit (not shown) of the appliance on the wiring patterns 7A and 7B, which being connected respectively with the light-transmitting electrode layer 2 and the back electrode layer 5, the luminescence layer 3 of the dispersion-type EL element is driven to generate light. The light illuminates a display window, a liquid crystal display panel, etc. from behind. Thus, the display or an operating section can be easily recognized or identified even in a dark operational environment.

Color of a light to be emitted from a dispersion-type EL element is determined by a kind of fluorescent powder dispersed in the luminescence layer 3 made of a dielectric resin having a high permittivity. The luminescence color can be converted into a color other than the intrinsic color of the fluorescent powder, by dispersing a fluorescent dye or a fluorescent pigment in the dielectric resin having a high permittivity, or by tinting the insulation film 1.

In a dispersion-type EL element having the above-described conventional structure, however, only a single color is available although a luminescence color can be converted into other color by dispersing a fluorescent dye or a fluorescent pigment in the dielectric resin having a high permittivity forming the luminescence layer 3, or by tinting the insulation film 1. When a plurality of luminescence colors are needed, a plurality of dispersion-type EL elements have to be installed in an electronic appliance. This incurs an increased number of parts in an appliance, which leads to an additional cost and time for the fabricating operation. Thus the total cost goes higher.

Another conventional dispersion-type EL element is shown in FIG. 17. On the upper surface of a light-transmitting insulation film 101, a light-transmitting electrode layer 102 of ITO or the like material is provided in the form of thin film by a vacuum sputtering process or the like method. On top of the electrode layer 102, a luminescence layer 103 comprising a cyano-group resin or a fluorocarbon rubber group resin having a high permittivity dispersed with granular fluorescent powder such as a copper-doped zinc sulfide, etc., and a dielectric layer 104 comprising a synthetic resin of the same group as the material of luminescence layer 103 dispersed with barium titanate or the like powder of high permittivity are formed respectively in the order by a coating process. Further on top, a back electrode layer 105 composed of a paste of silver-resin group or a carbon-resin group material and an insulation layer 106 for protecting the back electrode layer 105 from contacting with outside element are formed respectively. And then, an outlet electrode 107 of the light-transmitting electrode layer 102 and an outlet electrode 108 of the back electrode layer 105 are formed respectively. When an AC voltage is applied between the outlet electrode 107 and the outlet electrode 108, the fluorescent powder being dispersed in the luminescence layer 103 is driven to produce a plane luminescence at the light-transmitting insulation layer 101 side.

With the above-described structure as the basis, a conventional dispersion-type EL element (Japanese Patent Publication No.60-130097) comprises a light-transmitting electrode layer 109 disposed in the form of a number of stripes, as shown in FIG. 18(*a*). The electrode stripes in the odd number rows are connected together at one end, while those in the even number rows are connected together at the other end; thus, the light-transmitting electrode layer 109 is formed of two comb-shape electrodes 110 and 111 integrated into one entity without making mutual contact to each other. A luminescence layer 112 comprising two different luminescence colors is provided on the comb-shape electrodes 110, 111 in an arrangement where the luminescence color 112A is located on the odd number rows, while the luminescence color 112B is on the even number rows, as illustrated in FIG. 18(*b*). A multi-color luminescence is made available by applying independent voltages on two respective comb-shape electrodes 110, 111.

However, in a conventional dispersion-type EL element of the above-described structure, where two kinds of luminous bodies 112A, 112B composed of synthetic resin dispersed respectively with different fluorescent powders for producing different luminescence colors are provided by a screen printing process, or the like process, in the form of stripes one after the other on a location corresponding to respective comb-shape light-transmitting electrodes 110, 111, it is difficult to provide the stripes of a small line-width precisely into a fine-pitch pattern because fluorescent powders generally have a relatively large grain diameter of approximately 30 $\mu$m in average. If the stripe lines are formed in a rough-pitch pattern, the luminescence would appear to the eyes in a striped pattern rather than a plane luminescence when a voltage is applied on either one of the light-transmitting electrodes 110, 111 for producing a single-color luminescence. Thus the luminescence can hardly be recognized as a plane luminescence.

Furthermore, because of the large grain diameter of the fluorescent powder, thickness of the luminescence layer 112 is great and the surface condition is bumpy. When providing the luminous bodies 112A, 112B of two different colors alternately in a stripe form through a printing process, if there is a small deviation in the dimensions edges of the adjacent layers of different colors would readily be overlapped and the layer thickness of the overlapped portion increases, which makes the surface condition even bumpier. Then the printing of dielectric layer and back electrode layer on the luminescence layer would become difficult. Also, the electrode-to-electrode distance formed by the light-transmitting electrode layer and the back electrode layer becomes widely varied from place to place; which results in an uneven electrode-gap between the light-transmitting electrode layer and the back electrode layer, consequently an uneven luminescence would arise.

The present invention addresses the above-described drawbacks, and aims to offer a dispersion-type EL element that is capable of providing multiple colors in a homogeneous plane luminescence without accompanying an outstanding striped-appearance. More advantages of the dispersion-type EL element in accordance with the present invention include that mounting of the EL element on an electronic appliance is easy and that the manufacturing cost is low.

SUMMARY OF THE INVENTION

A dispersion-type EL element of the present invention is formed of a plurality of light-transmitting electrode layers and a plurality of luminescence layers composed of a dielectric resin having a high permittivity dispersed with fluorescent powder, each one of the respective layers being provided alternately one after the other over the whole region, or in a certain specific region, of one of the surfaces of a light-transmitting insulation film, and a back electrode layer is formed by a printing process on the last layer of the luminescence layers. In other example, two light-transmitting electrode layers having a comb shape of fine lines without making contact to each other, each of the electrode layers being capable of having different voltages independently to each other, are formed on one surface of a light-transmitting insulation film, and a luminescence layer of a single luminescence color is provided on the electrode layers; while, on the other surface of the light-transmitting insulation film, a color-conversion layer of a fine-teeth comb shape is provided in a location corresponding to at least one of the two light-transmitting electrode layers having a comb shape of fine lines, and a light diffusion layer is formed covering the outer surface.

In accordance with the above-described structure of the present invention, a dispersion-type EL element that is capable of providing several kinds of luminescence colors can be offered at a low cost. The plane luminescence provided by the EL element in a plurality of colors is homogeneous and stripes can hardly be recognized by the eyes in a normal operating environment.

BRIEF DESCRIPTION OF THE DRAWINGS

FIG. 18(*b*) is a cross sectional view of the light-transmitting electrode layer.

DESCRIPTION OF PREFERRED EMBODIMENTS

Figure 1:
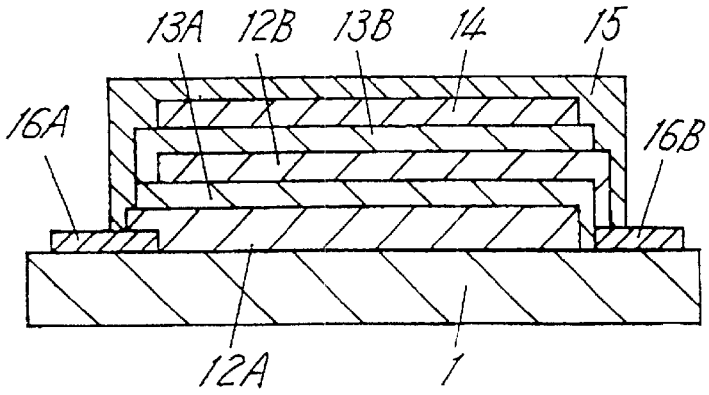
FIG. 1 is a cross sectional view of a dispersion-type EL element in accordance with a first exemplary embodiment of the present invention.

In the following, exemplary embodiments of the present invention will be described referring to the drawings. The drawings are shown magnified in the direction of thickness for the sake of easier illustration of the structures.

Those portions having the same structures as those of the already-described conventionals are represented with the same symbols, and detailed description of which is omitted here.

(Embodiment 1)

Figure 2:
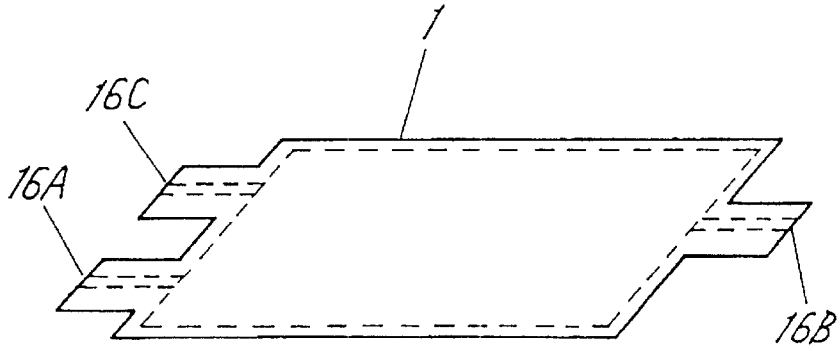
FIG. 2 is a perspective view of the dispersion-type EL element.

FIG. 1 is a cross sectional view of a dispersion-type EL element in accordance with a first exemplary embodiment of the present invention. FIG. 2 is a perspective view of the dispersion-type EL element. As shown in the drawings, a plurality of light-transmitting electrode layers 12A, 12B formed of flexible light-transmitting resin, such as phenoxy resin, epoxy resin, fluoro-carbon rubber, etc., dispersed with needle ITO or the like light-transmitting conductive powder, and a plurality of luminescence layers 13A, 13B each having different luminescence color composed of fluoro-carbon rubber, cyano-group resin or the like dielectric resin having a high permittivity dispersed with zinc sulfide or other phosphorescent, or phosphor, powder as the luminous body are formed alternately one after the other by a printing process on the whole surface, or in a certain specific region, of one of the surfaces of a flexible light-transmitting insulation film 1 composed of polyethylene telephtalate or the like.

A back electrode layer 14 composed of silver or a carbon-resin group conductive material connected to the luminescence layer 13B, and an insulation layer 15 composed of epoxy resin, polyester resin or the like material are further formed one after the other by a printing process. The end portions of wiring patterns 16A, 16B, 16C composed of silver or a carbon-resin group conductive material are connected respectively with the light-transmitting electrode layers 12A, 12B and the back electrode layer 14 to complete a finished dispersion-type EL element.

When a dispersion-type EL element of the above-described structure is mounted in an electronic appliance, and an AC voltage is applied from a circuit (not shown) of the electronic appliance on the wiring patterns 16A, 16B, 16C, which are connected with the light-transmitting electrode layers 12A, 12B and the back electrode layer 14, the luminescence layers 13A, 13B are driven to produce light for illuminating from behind a display panel, a liquid crystal display, etc. of the electronic appliance. The basic principle of producing light so far remains the same as in the prior arts. In a dispersion-type EL element in accordance with the present invention, however, the respective luminescence layers 13A, 13B produce different luminescence colors because each of the fluorescent powders dispersed in respective dielectric resin layers of high permittivity has its own luminescence color different to each other, or the color is converted to a different color by a fluorescent dye or a fluorescent pigment added in the dielectric resin of high permittivity.

For example, assuming the luminescence color of luminescence layer 13A is blue and that of luminescence layer 13B is orange, when an AC voltage is applied between the wiring patterns 16A and 16B, which are connected with the light-transmitting electrode layers 12A and 12B, the luminescence layer 13A produces blue light; when an AC voltage is applied between the wiring patterns 16B and 16C, which are connected with the light-transmitting electrode layer 12B and the back electrode layer 14, the luminescence layer 13B produces orange light; when an AC voltage is applied on all of the wiring patterns 16A, 16B and 16C both of the luminescence layers 13A and 13B produce lights of their own colors, which lights are composed to make yellow color.

As described in the above, in a dispersion-type EL element of the present embodiment, where a plurality of light-transmitting electrode layers 12A, 12B and a plurality of luminescence layers 13A, 13B of different colors are stacked alternately one after the other by a printing process, luminescence of various different colors can be produced. This enables to offer a multi-color dispersion-type EL element at an inexpensive cost.

Because the light-transmitting electrode layers 12A, 12B are formed using a flexible light-transmitting resin by a printing process, alike the other layers which are formed of flexible resin dispersed with various element powders, the dispersion-type EL element is flexible enough to be mounted on a curved surface, or may even be bent.

Tinting of the light-transmitting electrode layers 12A, 12B with fluorescent dye or fluorescent pigment added therein enables to create more varieties of colors, in combination with the luminescence colors from luminescence layers 13A, 13B.

Figure 3:
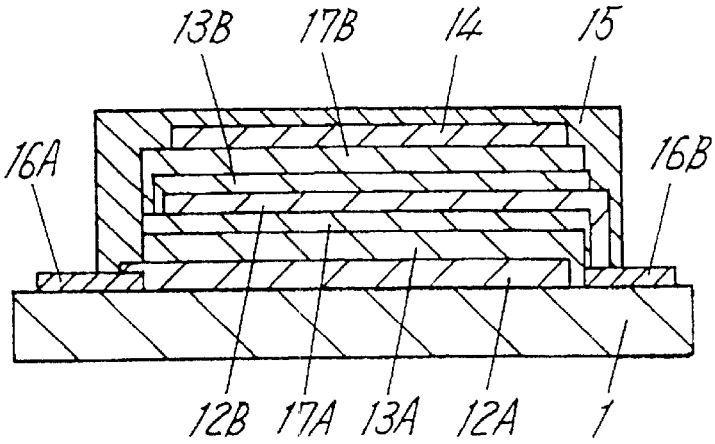
FIG. 3 is a cross sectional view of other dispersion-type EL element in accordance with a first exemplary embodiment.

Furthermore, formation of a dielectric layer 17A, 17B composed of the same material as the luminescence layer 13A, 13B, which being a fluoro-carbon rubber, a cyano-group resin or the like dielectric resin of high permittivity, dispersed with barium titanate or the like dielectric powder, over the luminescence layer 13A, 13B by a printing process, as shown in FIG. 3, makes the insulation between electrode layers surer, and, at the same time, a voltage effecting on the luminescence layer 13A, 13B becomes higher than on the dielectric layer 17A, 17B, which brings about an increased luminous intensity of the luminescence layer.

If, in the above-described structure, the quantity of barium titanate contained in the first dielectric layer 17A is too high the light from the second luminescence layer 13B is blocked. Therefore, it is preferred that the quantity of barium titanate contained in the second dielectric layer 17B is 60–95 weight % of the dielectric resin of high permittivity, while the quantity of barium titanate contained in the first dielectric layer 17A is 2–60 weight %.

The blocking of the light coming from luminescence layer can be suppressed to a minimum by using a fine-grain barium titanate, titanium oxide or the like dielectric powder of high permittivity, the grain size should preferably be less than 0.1 $\mu$m, or a hydrolysis organic metal, such as barium ethoxide, titanium ethoxide, etc., which produces a dielectric metal oxide of high permittivity as a result of hydrolysis, for the dielectric powder to be dispersed in the dielectric resin of high permittivity in the dielectric layer 17A, 17B.

The luminous intensity can be enhanced by making the second dielectric layer 17B white; because the lights from the luminescence layers 13A and 13B are reflected by the white dielectric layer towards the insulation film.

(Embodiment 2)

Figure 4:
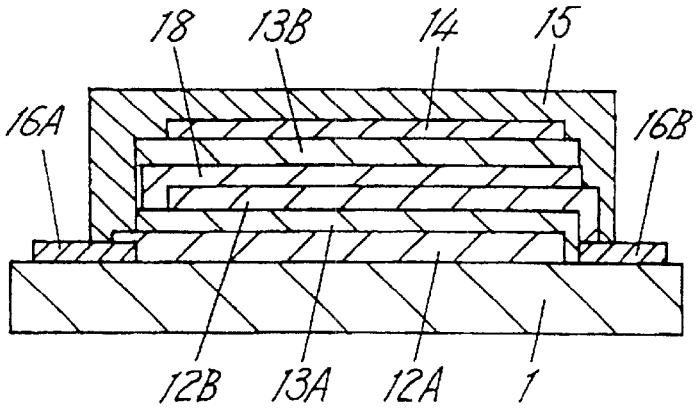
FIG. 4 is a cross sectional view of a dispersion-type EL element in accordance with a second exemplary embodiment of the present invention.

FIG. 4 is a cross sectional view of a dispersion-type EL element in accordance with a second exemplary embodiment of the present invention. The dispersion-type EL element comprises, alike the embodiment 1, a plurality of light-transmitting electrode layers 12A, 12B and a plurality of luminescence layers 13A, 13B provided alternately one after the other by a printing process on the whole surface, or in a certain specific region, of one of the surfaces of a light-transmitting insulation film 1, and a back electrode layer 14 and an insulation layer 15 are formed thereon; and the end portions of wiring pattern 16A, 16B, 16C (not shown) are connected respectively with the light-transmitting electrode layers 12A, 12B and the back electrode layer 14. The point of difference as compared with the embodiment 1 is that there is a light conversion layer 18 composed of polyester resin, epoxy resin, acrylic resin, phenoxy resin, fluorocarbon rubber or the like material dispersed with fluorescent dye or fluorescent pigment, formed in between the second light-transmitting electrode layer 12B and the luminescence layer 13B by a printing process.

Under the above-described structure, assuming the luminescence color of luminescence layers 13A, 13B is, for example, blue and the color conversion layer 18 is orange; when an AC voltage is applied between the wiring patterns 16A and 16B, which are connected with the light-transmitting electrode layers 12A, 12B, the luminescence layer 13A produces blue light. When an AC voltage is applied between the wiring patterns 16B and 16C, which are connected with the light-transmitting electrode layer 12B and the back electrode layer 14, the luminescence layer 13B produces also blue light, but the light is converted into orange color by the light conversion layer 18. When an AC voltage is applied on all of the wiring patterns 16A, 16B and 16C, the blue color from luminescence layer 13A and the orange color from light conversion layer 18 are composed to produce yellow color.

As described in the above, in a dispersion-type EL element of the present embodiment,,where there is a color conversion layer 18 provided in between the second layer of the light-transmitting electrode layer 12B, or a layer after the second, and the luminescence layer 13B, the luminescence color from respective luminescence layers can be converted into other color. Therefore, varieties of colors may be produced out of the luminescence layers 13A, 13B having a same luminescence color. This enables to offer a multi-color dispersion-type EL element at an inexpensive cost.

Figure 5:
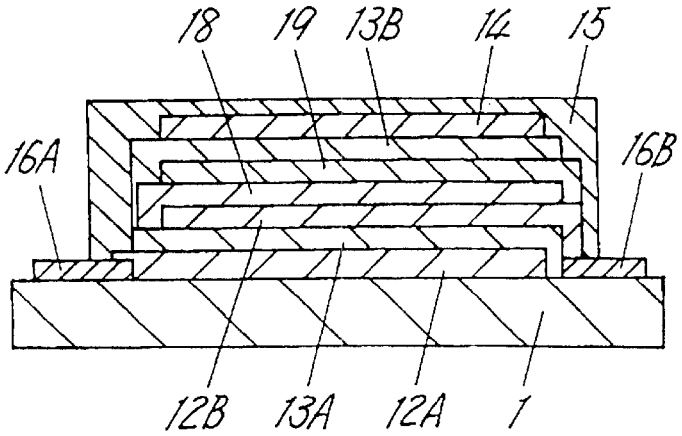
FIG. 5 is a cross sectional view of other dispersion-type EL element in accordance with a second exemplary embodiment of the present invention.

Because the luminescence layer 13B is sandwiched by the light-transmitting electrode layer 12B and the back electrode layer 14 with the color conversion layer 18 interposed, luminous intensity of the luminescence layer 13B decreases by approximately 5–30%. However, the deterioration of luminous intensity can be alleviated by a light-transmitting conductive layer 19 provided by a printing process over the color conversion layer 18, as illustrated in FIG. 5, which conductive layer being connected with the light-transmitting electrode layer 12B. Thus, the luminescence layer 13B is provided with an AC voltage direct from the light-transmitting conductive layer 19 and the back electrode layer 14.

Although the foregoing descriptions are based on two light-transmitting layers and two luminescence layers provided through a printing process overlaid one after the other, the layers may of course be provided in a structure of three, four or more number of stacked layers for producing more number of luminescence colors.

The first light-transmitting electrode layer 12A may be formed by a sputtering process or an electron beam method. However, for the second light-transmitting electrode layer, which is formed on the luminescence layer 13A, it is difficult in practice to provide it thorough the sputtering or the electron beam method. Therefore, it is usually formed by a printing process. The sheet resistance value should preferably be lower than 1K Ohms. However, no substantial deterioration is observed in the luminous intensity in so far as it is lower than approximately 50K Ohms.

Although the foregoing descriptions are based on a structure comprising a plurality of light-transmitting electrode layers 12A, 12B, a plurality of luminescence layers 13A, 13B, a color conversion layer 18, etc. formed covering the entire region of one of the surfaces of the insulation film 1, these layers may of course be formed instead only in a certain specific region of the surface, or a layer in the right area may have a luminescence color that is different from that of the left area, or the color in the upper area may be different from that of the lower area, for example. Under such configurations, composition and conversion of the luminescence colors may be carried out in more varieties of combinations. In this way, a dispersion-type EL element capable of producing more number of colors is provided.

(Embodiment 3)

A third exemplary embodiment of the present invention is described below with reference to the drawings.

Figure 6:
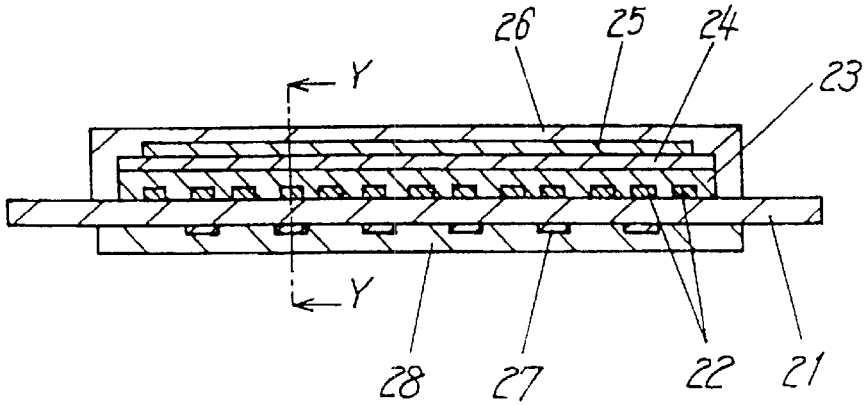
FIG. 6 is a cross sectional view of a dispersion-type EL element in accordance with a third exemplary embodiment of the present invention.

FIG. 6 is a cross sectional view of a dispersion-type EL element in accordance with a third exemplary embodiment of the present invention. A light-transmitting electrode layer 22 is provided on one of the surfaces of an insulation film 21 in the form of stripes of fine lines by a printing process. On the light-transmitting electrode layer 22, a luminescence layer 23 of a single luminescence color, a dielectric layer 24, a back electrode layer 25 are printed one after the other. And an insulation layer 26 is formed by a printing process covering the back electrode layer 25. On the other surface of the insulation film 21, opposite to the surface having the light-transmitting electrode layer 22, a color conversion layer 27 is provided by a printing process in the form of stripes placed only in a location corresponding to the stripes of even number lines of the light-transmitting electrode layer 22. A light diffusion layer 28 is formed covering the color conversion layer 27, as illustrated in FIG. 6.

Figure 7:
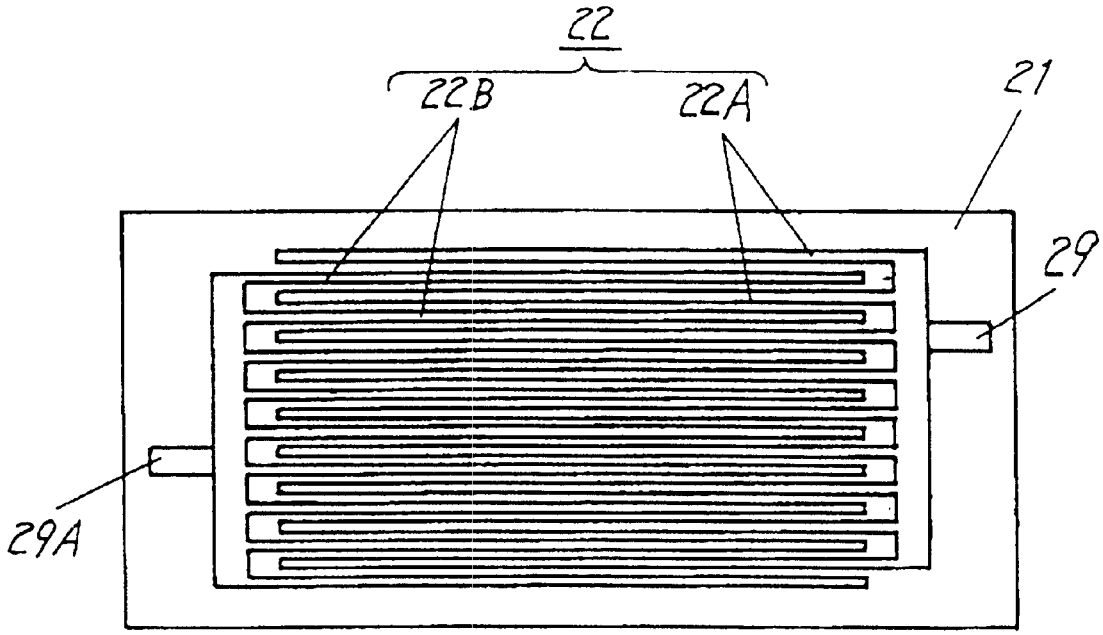
FIG. 7 is a plan view of a light-transmitting electrode layer, being a key portion of the dispersion-type EL element.

FIG. 7 is a plan view of the light-transmitting electrode layer 22; among the fine lines of the comb-teeth light-transmitting electrode layer 22, coupled but without making contact to each other, formed on the insulation film 21, the electrode teeth 22A of odd number lines are connected together at one end to be coupled with an outlet electrode 29 provided at the same side as the end, while the electrode teeth 22B of even number lines are connected together at the other end to be coupled with an outlet electrode 29A provided at the same side as the other end.

Figure 8:
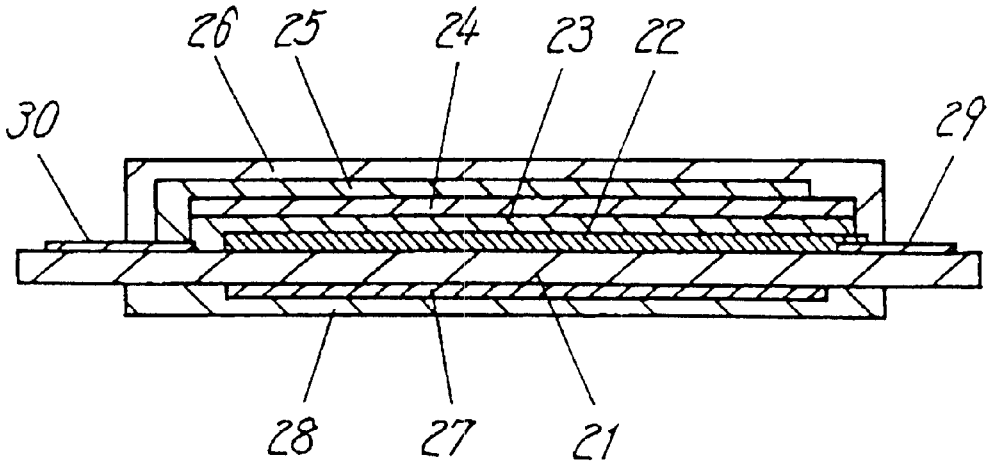
FIG. 8 is a cross sectional view along the line Y—Y of FIG. 6.

FIG. 8 shows a cross sectional view of the dispersion-type EL element, along the line Y—Y of FIG. 6. The outlet electrode 29 (29A) is connected with the light-transmitting electrode layer 22A (22B) at the end portion, and is disposed at an edge area of the insulation film 21 to be ready for connection with an outside circuit (not shown).

Figure 9:
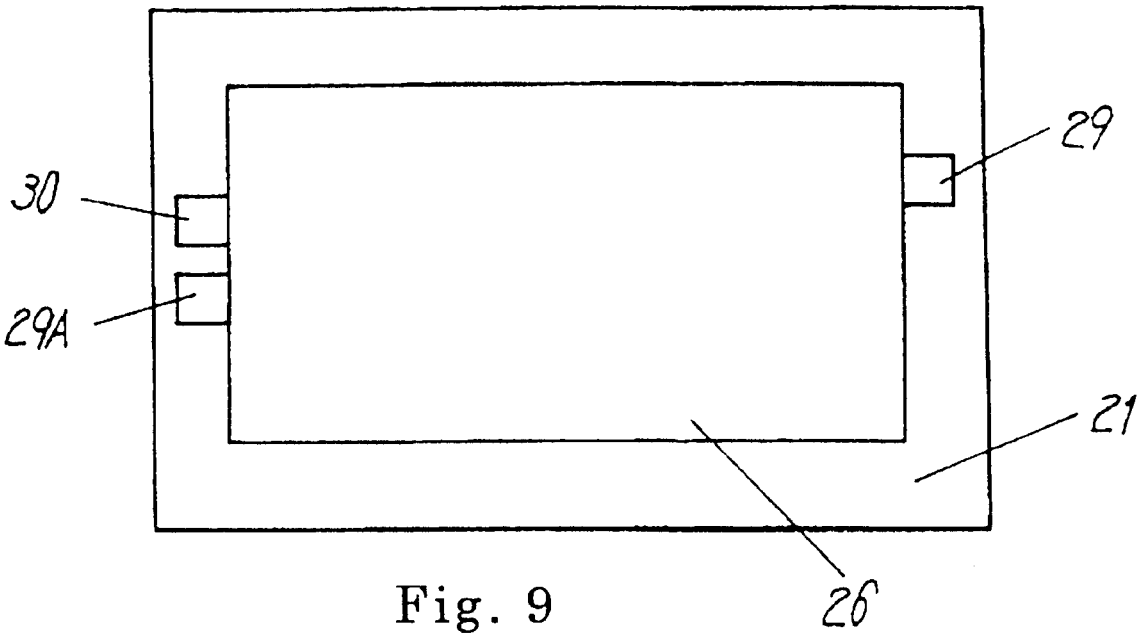
FIG. 9 is a plan view of the dispersion-type EL element.

As shown in FIG. 8 and FIG. 9, another outlet electrode 30 coupled with the back electrode layer 25 is provided on the insulation film 21 at a place in one edge area so as not making contact with the outlet electrode 29, or 29A, of the light-transmitting electrode layer 22.

Figure 10:
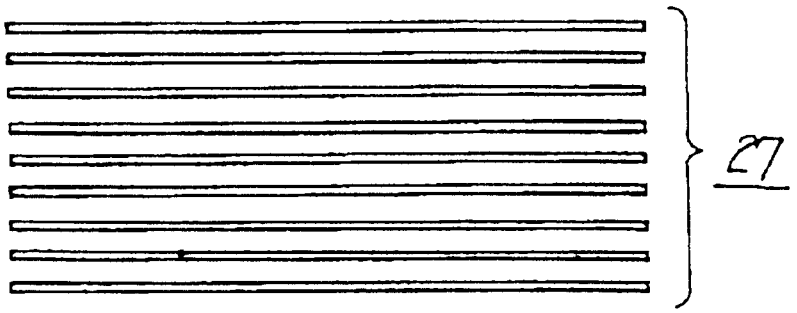
FIG. 10 shows a pattern of color conversion layer, being a key portion of the dispersion-type EL element.

FIG. 10 shows a pattern of the color conversion layer 27; stripe lines of the color conversion layer 27 are disposed only at the locations corresponding to the even number lines of electrodes 22B of the light-transmitting electrode layer 22 illustrated in FIG. 6.

In the above-described drawings, dimensions in the direction of thickness have been shown magnified for the sake of easier illustration of the structure that is relevant to the present invention. The line width as well as the stripe pitch of the light-transmitting electrode layer 22 and the color conversion layer 27 have been illustrated in a scale larger than the actual, and the number of stripe lines has been reduced in the illustration.

In the above-described structure, the light-transmitting electrode layer 22 is formed with a light-transmitting conductive paste of needle powder ITO having preferably a diameter of approximately 2–3 $\mu$m, dispersed in polyester resin, epoxy resin, acrylic resin, phenoxy resin, fluorocarbon rubber resin, or the like material, the sheet resistance value of which layer should preferably be lower than 5 k□/cm$^2$, printed by a screen printing or the like process into a pattern of comb-teeth of fine lines coupled one tooth after the other without making contact to each other, and then dried.

The luminescence layer 23 is formed by screen-printing and drying a paste of EL fluorescent powder dispersed in cyanoethyl cellulose resin, cyanoethyl pullulan resin, fluorocarbon rubber resin containing vinylidene fluoride, or the like material having a high permittivity. The dielectric layer 24 is formed by screen-printing and drying a paste of barium titanate or the like white fine-grain powder of high permittivity dispersed in a resin of the same group as used for the paste of luminescence layer 23. The back electrode layer 25 and the outlet electrodes 29, 29A, 30 are formed by screen-printing and drying a silver paste or a carbon paste for use in membrane switch, etc. The insulation layer 26 is formed by screen-printing and drying an electrically insulating paste of polyester, vinyl chloride, fluoro-carbon rubber, polyurethane, epoxy or the like material. The color conversion layer 27 is formed by screen-printing and drying a paste of fluorescent dye or fluorescent pigment having a preferred average grain diameter smaller than 10 $\mu$m dispersed in an insulating transparent resin such as polyester resin, epoxy resin, phenoxy resin, urethane resin, acrylic resin, polycarbonate resin, etc.

In dispersing a fluorescent pigment in the color conversion layer 27, if the fluorescent pigment used has a grain diameter smaller than 30 $\mu$m, which being the average diameter of the EL fluorescent powder used in luminescence layer 23, it will produce a luminescence that has a line width finer than that of the striped pattern as referred to in BACKGROUND OF THE INVENTION. It is preferred, however, to use a fluorescent pigment whose grain diameter is smaller than 10 $\mu$m in average, if a pattern of higher stripe density is to be formed in order to produce a plane luminescence of even higher level of homogeneous representation.

The light diffusion layer 28 may be provided, for example, by means of:

1. Disposing on the luminescence surface a sheet of a certain appropriate thickness needed for diffusing a light containing a number of boundary faces having different index of refraction, such as a colorless foamed resin sheet.
2. Applying a colorless forming resin paste on the luminescence surface once or several times until it reaches a certain appropriate thickness, and having it formed.
3. Applying on the luminescence surface a paste of glass beads of high refraction index dispersed in a transparent synthetic resin of low refraction index, once or several times until it reaches a certain appropriate thickness.
4. Providing a film sheet having a rough surface and a high haze rate on the luminescence surface at an appropriate interval.
5. Providing on the luminescence surface an opalescent light-scattering resin sheet of an appropriate thickness dispersed with a small quantity of fine-grain titanium oxide, etc.
6. Applying an opalescent resin paste on the luminescence surface for an appropriate thickness.

Now in the following, the operation of a dispersion-type EL element having the above structure is described.

Assuming the light of fluorescent powder contained in the luminescence layer 23 is, for example, blue and the color of color conversion layer 27 is orange, when an AC voltage is applied between the outlet electrode 30 connected with back electrode layer 25 and the outlet electrode 29 connected with electrode 22A, which being the odd number lines of the light-transmitting electrode layer 22, the blue light produced in the luminescence layer 23 proceeds direct to the light diffusion layer 28, not going through the color conversion layer 27, to be diffused there and emitted to outside as blue light. When an AC voltage is applied between the outlet electrode 30 connected with back electrode layer 25 and the outlet electrode 29A connected with electrode 22B, which being the even number lines of the light-transmitting electrode layer 22, the blue light produced in the luminescence layer 23 goes through the color conversion layer 27 to be converted there into orange color and emitted to outside as orange light. When an AC voltage is applied on the outlet electrode 30 of back electrode layer 25 and both of the two outlet electrodes 29, 29A of light-transmitting electrode layer 22, a composite color, yellow-white, is provided.

In the present embodiment of the invention having a luminescence layer 23 composed of a single luminous body of one luminescence color provided over the whole surface area, the light-transmitting electrode layer 22 composed of two electrodes 22A, 22B having a comb shape of fine lines and the color conversion layer 27 can be provided in the form of fine lines of very small line width by the use of fine-grain powders of needle ITO, fluorescent dye or fluorescent pigment. Furthermore, as the lights are diffused at the light diffusion layer 28 the stripes are not outstanding to the eyes under normal operating conditions. Thus the three colors can be produced in a homogeneous plane luminescence.

The paste for forming the luminescence layer may also be provided by using a synthetic resin tinted with a fluorescent dye or a fluorescent pigment.

Although in the present embodiment the formation of light-transmitting electrode layer has been described based on a printing process using a conductive paste, it may be provided instead by first forming a transparent thin-film of ITO, or tin oxide, through a sputtering or an electron beam method and then etching the thin-film into the comb shape of fine lines.

(Embodiment 4)

Figure 11:
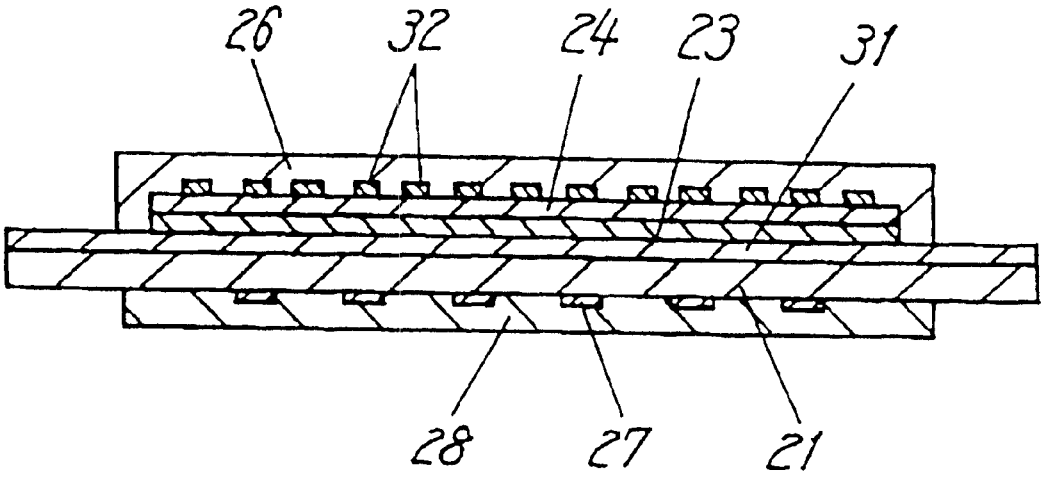
FIG. 11 is a cross sectional view of a dispersion-type EL element in accordance with a fourth exemplary embodiment of the present invention.

FIG. 11 shows a cross sectional view of a dispersion-type EL element in accordance with a fourth exemplary embodiment of the present invention. The point of difference as compared with the embodiment 3 is in the shapes of light-transmitting electrode layer 31 and the back electrode layer 32.

Namely, the light-transmitting electrode layer 31 is provided using the same material as that in the embodiment 3, but it is formed on one of the surfaces of an insulation film 21 covering the whole area. The back electrode layer 32 is provided using also the same material as that in the embodiment 3, viz. a paste containing silver powder or carbon powder of extremely fine grain size, but it is provided in a form similar to that of the light-transmitting electrode layer 22 in the embodiment 3, viz. it is provided on the dielectric layer 24 in two groups of comb shape of fine lines coupled one tooth after the other without making contact to each other; electrode lines of odd number rows are connected together at one end, while those of even number rows are connected together at the other end, to be coupled respectively with outlet electrodes (not shown) disposed in the same side of the respective ends.

The operation of the above dispersion-type EL element is described below.

Assuming, for example, the luminescence color of luminescence layer 23 is blue, color of the color conversion layer 27 is orange; when an AC voltage is applied between the light-transmitting electrode layer 31 and one of the two electrodes of the back electrode layers 32 having a comb shape of fine lines, it produces blue luminescence color. When an AC voltage is applied between the light-transmitting electrode layer 31 and the other electrode of the back electrode layer 32, it produces orange light. When an AC voltage is applied on the light-transmitting electrode layer 31 and both of the two electrodes of the back electrode layer 32 having a comb shape of fine lines, it produces a composite color, yellow-white.

In the present embodiment having a luminescence layer 23 composed of a single luminous body of one luminescence color provided, like in the example of embodiment 3, over the whole surface area, the back electrode layer 32 composed of two groups of comb shape of fine lines and the light conversion layer 27 can be provided in the form of fine lines of very small line width by the use of fine-grain powders of silver, carbon, fluorescent dye or fluorescent pigment. Furthermore, as the lights are diffused at the light diffusion layer 28 the stripes are not outstanding to the eyes under normal operating conditions. Thus the three colors can be produced in a homogeneous plane luminescence.

(Embodiment 5)

Figure 12:
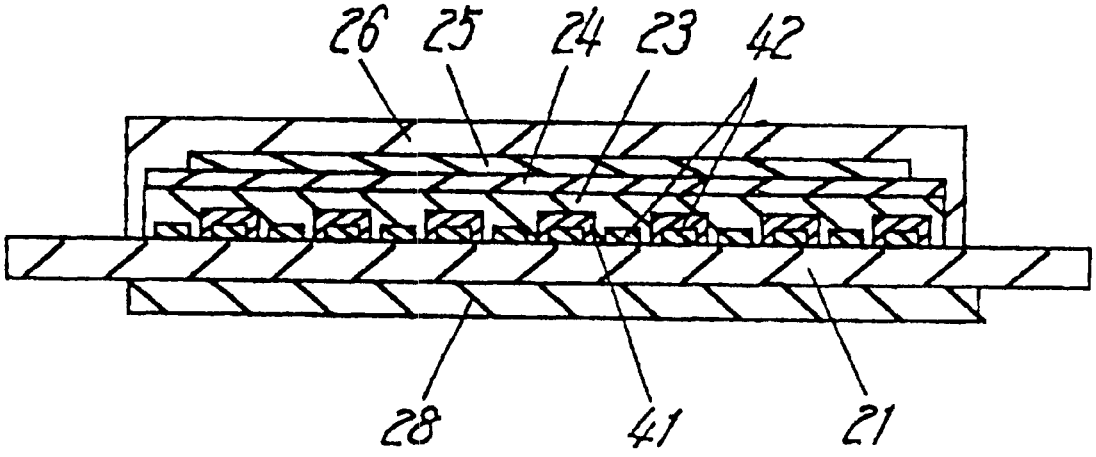
FIG. 12 is a cross sectional view of a dispersion-type EL element in accordance with a fifth exemplary embodiment of the present invention.

FIG. 12 shows a cross sectional view of a dispersion-type EL element in accordance with a fifth exemplary embodiment of the present invention. The point of difference as compared with the element of embodiment 3 is in the position of color conversion layer 41.

Namely, while in the embodiment 3 the light-transmitting electrode layer 22 is formed by printing on one of the surfaces of insulation film 21 and the color conversion layer 27 is formed by printing on the other surface, in the present embodiment 5 a light-transmitting electrode layer 42 composed of two sets of fine lines of comb-teeth coupled one after the other is formed first on one surface of an insulation film 21 and then a color conversion layer 41 is formed by printing to cover the surface of one set of the electrode teeth lines. Other constituent portions of the present embodiment 5 remain the same as those of the embodiment 3.

A dispersion-type EL element of the present embodiment 5 operates on the same operating principle as that of the embodiment 3; so detailed description of which is omitted here. In a same manner as in the embodiment 3, the light-transmitting electrode layer 42 and the color conversion layer 41 of the present embodiment 5 are formed at a very fine line-width; therefore, a multiple number of colors are produced in a homogeneous plane luminescence, where the stripes are not seen outstanding from the eyes under a normal working environment. The color conversion layer 41 formed in stripes is printed direct on the light-transmitting electrode layer 42 of fine line comb-teeth shape, so the aligning can be made precisely with ease and occurrence of a possible dislocation between the color conversion layer 41 and the light-transmitting electrode layer 42 is prevented. Thus, the key constituent portion relevant to producing a multiple number of colors are formed at a high precision level, and displacement of colors is effectively eliminated.

(Embodiment 6)

Figure 13:
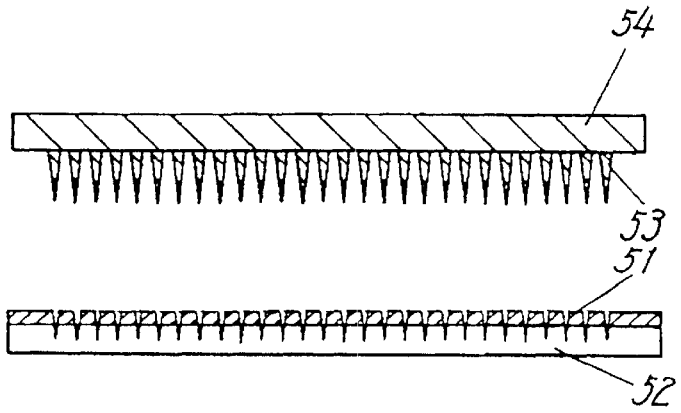
FIG. 13 is a cross sectional view of an insulation film, a light-transmitting electrode layer and a Thomson mould, being key portions of a dispersion-type EL element in accordance with a sixth exemplary embodiment of the present invention

FIG. 13 shows a cross sectional view of an insulation film, a light-transmitting electrode layer having a comb shape of fine lines and a Thomson mould, which being key portions of a dispersion-type EL element in accordance with a sixth embodiment of the present invention. The point of difference as compared with the embodiment 3 is in the method of forming a light-transmitting electrode layer having a comb shape of fine lines.

Namely, the light-transmitting electrode layer 51 having a comb shape of fine lines is provided by first forming a transparent conductive film of ITO or zinc oxide on the insulation film 52 over the whole area through sputtering or the like process, and then cutting the transparent conductive film using a Thomson mould 54 equipped with a blade 53. Other constituent portions of the present embodiment 6 remain the same as those of the embodiment 3.

A dispersion-type EL element of the present embodiment operates on the same operating principle as that of the embodiment 3; so detailed description of which is omitted here. The light-transmitting electrode layer 51 composed of two groups of comb-teeth fine lines in the present embodiment 6 is provided by first forming a transparent conductive film on the insulation film 52 over the whole area through a sputtering process, and then cutting the transparent conductive film using a Thomson mould 54. In this way, the light-transmitting electrode layer 51 having comb-teeth fine lines of fine pitch can easily be provided without relying on an etching method, the facilities for which method is expensive. Thus, a multiple number of colors are produced in a homogeneous plane luminescence, where the stripes are not seen outstanding from the eyes under a normal working environment.

(Embodiment 7)

Figure 14:
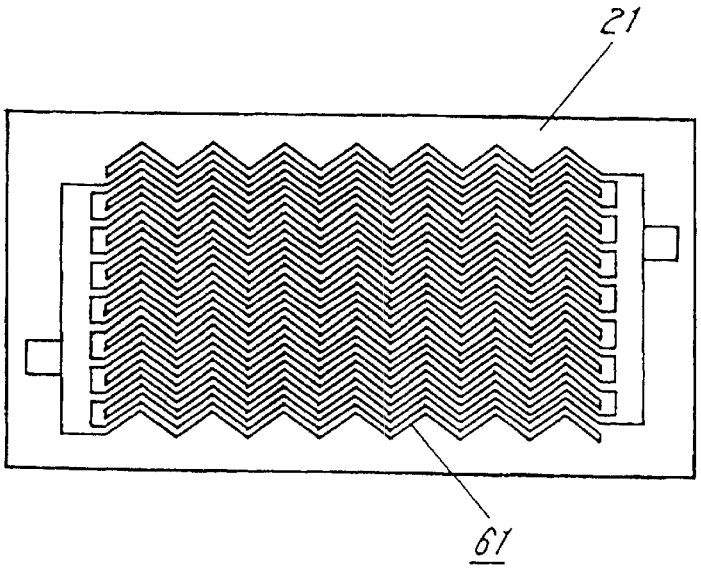
FIG. 14 is a plan view of a light-transmitting electrode layer, being a key portion of a dispersion-type EL element in accordance with a seventh exemplary embodiment of the present invention.
Figure 15:
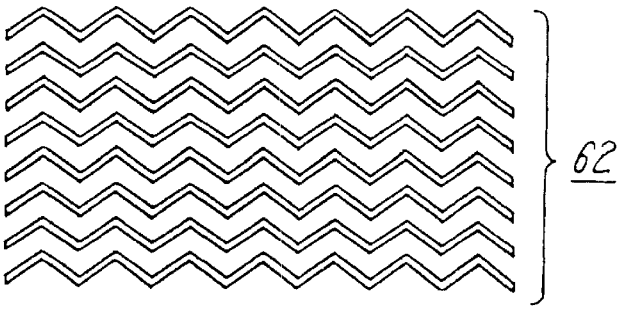
FIG. 15 is a plan view of a color conversion layer, being a key portion of the dispersion-type EL element.
Figure 16:
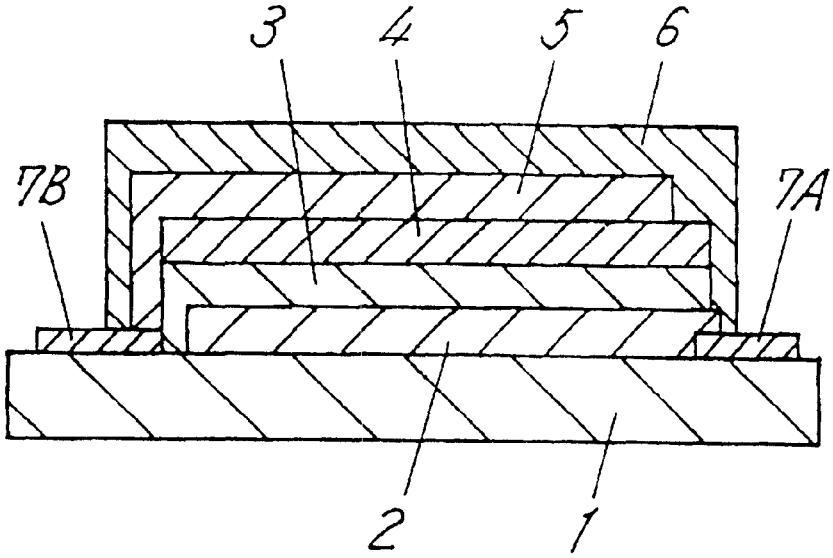
Fig. 16 PRIOR ART
FIG. 16 is a cross sectional view of a conventional dispersion-type EL element.
Figure 17:
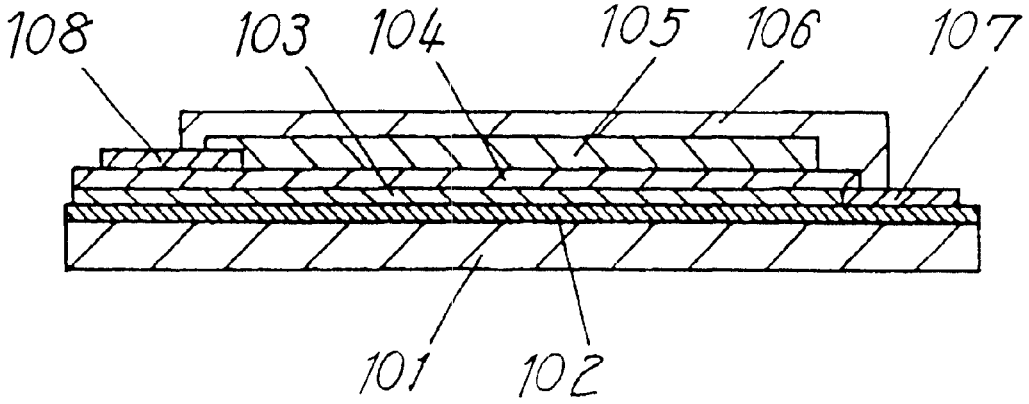
Fig. 17 PRIOR ART
FIG. 17 is a cross sectional view of other dispersion-type EL element having a conventional structure.
Figure 18A:
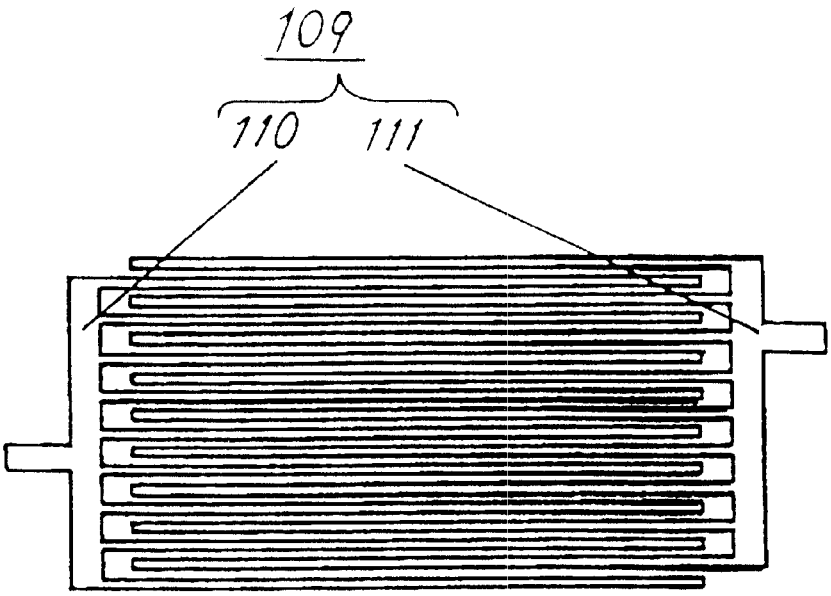
Fig. 18(a) PRIOR ART
FIG. 18(*a*) is a plan view of a light-transmitting electrode layer, being a key portion of the conventional dispersion-type EL element.
Figure 18B:
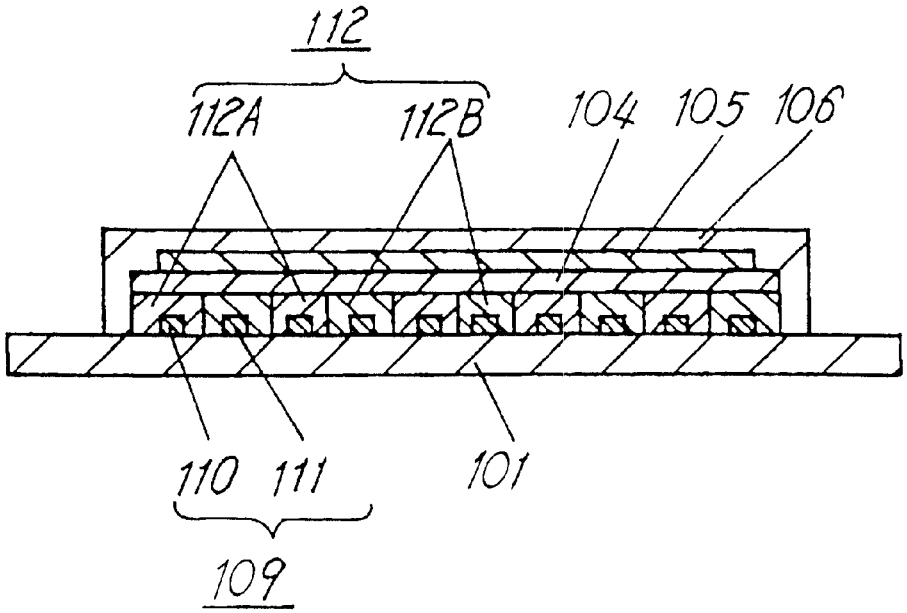
Fig. 18(b) PRIOR ART

FIG. 14 and FIG. 15 are plane views of a light-transmitting electrode layer having a comb-shape of fine lines and a color conversion layer, which being key portions of a dispersion-type EL element in accordance with a seventh exemplary embodiment of the present invention. The point of difference as compared with the embodiment 3 is in the shapes of light-transmitting electrode layer 61 and the color conversion layer 62.

Namely, the light-transmitting electrode layer 61 composed of two groups of comb shape of fine lines coupled one tooth after the other without making contact to each other is provided on one of the surfaces of an insulation film 21, the comb-teeth lines taking a parallel wave form arrangement. On the other surface of insulation layer 21, the color conversion layer 62 of an identical parallel wave form is provided in a location corresponding to one of the two groups of electrode lines of light-transmitting electrode layer. Other constituent portions of the present embodiment 7 remain the same as those of the embodiment 3.

A dispersion-type EL element of the present embodiment operates on the same operating principle as that of the embodiment 3; so detailed description of which is omitted here. A dispersion-type EL element of the present embodiment provides homogeneous plane luminescence in multiple colors without accompanying the striped luminescence recognizable by the eyes under normal operating conditions. In addition, because the waving forms of the fine teeth-lines of the light-transmitting electrode layer 61 and the color conversion layer 62 improves the effect of diffusing a light by a light diffusion layer, thickness of the light diffusion layer needed to make the diffused light sufficiently homogeneous can be reduced.

As described in the above, a light-transmitting electrode layer, a back electrode layer and a color conversion layer in a dispersion-type EL element of the present invention are provided by using fine-grain conductive material or fluorescent material having a grain size much smaller than that of fluorescent powder dispersed in the luminescence layer. Therefore, the light-transmitting electrode layer, the back electrode layer and the color conversion layer can be provided in a stripe form of fine lines having an extremely fine line-width that is much smaller than that of the stripes of a luminescence layer. Thus, a dispersion-type EL element capable of producing multiple number of colors in a homogeneous plane luminescence without accompanying the stripes recognizable by the eyes under a normal operating environment can be offered at low cost.

What is claimed is:

1. A dispersion-type electroluminescence element comprising:

a light-transmitting insulation film;

a plurality of light-transmitting electrode layers, and a plurality of luminescence layers having different colors each comprising a dielectric resin with phosphor powder dispersed therein, the respective layers located in an alternating sequence on at least a portion of one of the surfaces of the light-transmitting insulation film; and a back electrode layer located on a final layer of the luminescence layers.

2. A dispersion-type electroluminescence element comprising:

a light-transmitting insulation film;

a plurality of light-transmitting electrode layers, and a plurality of luminescence layers each comprising a dielectric resin with phosphor powder dispersed therein, the respective layers located in an alternating sequence on at least a portion of one of the surfaces of the light-transmitting insulation film;

a color conversion layer located between the second layer, or a layer after the second of light-transmitting electrode layer, and a luminescence layer and a back electrode layer located on the final layer- of the luminescence layers.

3. The dispersion-type electroluminescence element of claim 2, further comprising a light-transmitting conductive layer located on the color conversion layer.

4. The dispersion-type electroluminescence element of claim 1, further comprising a dielectric layer located on the luminescence layer and comprising a dielectric resin having dispersed therein a dielectric powder.

5. The dispersion-type electroluminescence element of claim 4, wherein the uppermost layer of the dielectric layer is white.

6. The dispersion-type electroluminescence element of claim 1, wherein the light-transmitting electrode layer comprises a light-transmitting resin dispersed therein a light-transmitting electro-conductive powder.

7. The dispersion-type electroluminescence element of claim 4, wherein the light-transmitting electrode layer comprises a light-transmitting resin having dispersed therein a light-transmitting electro-conductive powder.

8. The dispersion-type electroluminesce element of claim 1, wherein the light-transmitting electrode layer includes a fluorescent color tint.

9. The dispersion-type electroluminescence element of claim 4, wherein the light-transmitting electrode layer includes a fluorescent color tint.

10. The dispersion-type electroluminescence element of claim 6, wherein the light-transmitting electrode layer includes a fluorescent color tint.

11. A dispersion-type electroluminescence element comprising:

a light-transmitting insulation layer having two opposing surfaces, two light-transmitting comb shaped electrodes each having a set of interconnected parallel teeth for conducting an independent voltage, the two sets of teeth interlaced without making contact with each other and located on one of the surfaces of the light-transmitting insulation layer;

a luminescence layer having a luminescence color, a dielectric layer and a back electrode layer, each comprising a flexible resin having dispersed therein with powdered material, stacked one on the other over the entirety of the light-transmitting electrode layer; and a color conversion layer having a color different from the luminescence color of said luminescence layer, located on the other surface of said insulation film in a striped pattern aligned with at least one of said two light-transmitting comb-shaped electrodes.

12. A dispersion-type electroluminescence element comprising:

a light-transmitting insulation film having two opposing surfaces;

a light-transmitting electrode layer located on the entirety of one of the surfaces of the insulation film, a luminescence layer, and a dielectric layer each comprising a flexible resin having dispersed therein powdered material, the layers stacked on the light-transmitting electrode layer and two comb-shaped electrodes each having a set of interconnected parallel teeth for conducting an independent voltage, the two sets of teeth interlaced without making contact with each other and located on the dielectric layer; and a color conversion layer located on the other surface of said light-transmitting insulation film, having a color different from the luminescence color of said luminescence layer, in a striped pattern aligned with at least one of said two comb-shaped electrodes.

13. The dispersion-type electroluminescence element of claim 11, further comprising a light diffusion layer located on the light-transmitting insulation film covering the whole surface where the color conversion layer is located.

14. The dispersion-type electroluminescence element of claim 12, further comprising a light diffusion layer located on the light-transmitting insulation film covering the whole surface where the color conversion layer is located.

15. The dispersion-type electroluminescence element of claim 11, wherein the light-transmitting electrode layer comprises a dried, light-transmitting electro-conductive paste of transparent synthetic resin having dispersed therein powder of indium tin oxide.

16. The dispersion-type electroluminescence element of claim 15, wherein the color conversion layer is located on the light-transmitting electrode layer.

17. The dispersion-type electroluminescence element of claim 11, wherein two light-transmitting comb shaped electrodes comprise a transparent conductive film of indium tin oxide, or tin oxide, over the whole region of one of the surfaces of light-transmitting insulation film.

18. The dispersion-type electroluminescence element of claim 11, wherein the color conversion layer comprises a synthetic resin containing fluorescent dye dissolved therein, or a synthetic resin having dispersed therein fluorescent pigment having an average grain diameter not greater than 10 Fm.

19. The dispersion-type electroluminescence element of claim 11, wherein the dielectric layer comprises a synthetic resin having dispersed therein a white dielectric material.

20. The dispersion-type electroluminescence element of claim 11, wherein either the light-transmitting electrode layer or the back electrode layer comprises two comb shaped electrodes each having a set of interconnected parallel non-straight teeth for conducting an independent voltage, the two sets of teeth interlaced without making contact with each other and located on either the light-transmitting electrode layer or the back electrode layer, and said color conversion layer having a color different from the luminescence color of the luminescence layer comprises an arrangement of parallel non-straight teeth identical and aligned with at least one of the two sets of interconnected parallel non-straight teeth.

21. The dispersion-type electroluminescence element of claim 1, wherein the plurality of luminescence layers are formed by a printing process.

22. The dispersion-type electroluminescence element of claim 2, wherein the plurality of luminescence layers are formed by a printing process.

* * * * *